US009842712B2

(12) United States Patent
Mishra et al.

(10) Patent No.: US 9,842,712 B2
(45) Date of Patent: Dec. 12, 2017

(54) SWITCHING DEVICE HAVING TERMINAL COVER, AND METHOD

(71) Applicant: General Electric Company, Schenectady, NY (US)

(72) Inventors: Ashish Mishra, New Britain, CT (US); Allison Conner, Brooklyn, NY (US); Piotr Slawomir Woronkowicz, Brooklyn, NY (US); Jung Soo Park, Brooklyn, NY (US); Anurag Arjundas Jivanani, Plainville, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/054,643

(22) Filed: Feb. 26, 2016

(65) Prior Publication Data

US 2016/0260560 A1 Sep. 8, 2016

Related U.S. Application Data

(60) Provisional application No. 62/129,218, filed on Mar. 6, 2015.

(51) Int. Cl.
*H01H 13/04* (2006.01)
*H01H 21/04* (2006.01)
(Continued)

(52) U.S. Cl.
CPC ..... *H01H 21/04* (2013.01); *H01H 9/0264* (2013.01); *H01H 71/52* (2013.01); *H01H 71/0264* (2013.01); *H01H 2071/0242* (2013.01)

(58) Field of Classification Search
CPC . H01H 9/0264; H01H 71/0264; H01R 13/447
(Continued)

(56) References Cited

U.S. PATENT DOCUMENTS 4,774,390 A * 9/1988 Lehman ..... H01H 9/0264 174/138 F
4,979,634 A 12/1990 Begley
(Continued)

FOREIGN PATENT DOCUMENTS

DE 29503690 U1 4/1995
EP 0220567 A2 5/1987
(Continued)

OTHER PUBLICATIONS

European Search Report and Opinion issued in connection with corresponding EP Application No. 16158424.8 dated Jul. 7, 2016.

*Primary Examiner* — Vanessa Girardi
(74) *Attorney, Agent, or Firm* — General Electric Company

(57) ABSTRACT

A switching device is provided. The switching device includes a housing including a base and a switching device cover coupled to the base, a line side terminal positioned on a line side of the housing, a load side terminal positioned on a load side of the housing, wherein the line side is opposite the load side, a first terminal cover coupled to the switching device cover proximate the line side, and a second terminal cover coupled to the switching device cover proximate the load side, wherein the first terminal cover is movable between a closed position and an open position, wherein the first terminal cover is attached to said switching device cover in both the closed and open positions, and wherein the second terminal cover is attached to the switching device cover in both the closed and open positions.

24 Claims, 16 Drawing Sheets

(51) Int. Cl.
*H01H 9/02* (2006.01)
*H01H 71/52* (2006.01)
*H01H 71/02* (2006.01)

(58) Field of Classification Search
USPC ..... 200/293, 333; 439/718
See application file for complete search history.

(56) References Cited

U.S. PATENT DOCUMENTS

| | | | | |
|---|---|---|---|---|
| 5,486,666 | A | 1/1996 | Wong et al. | |
| 6,229,418 | B1 | 5/2001 | Mueller et al. | |
| 6,262,880 | B1 | 7/2001 | Fischer et al. | |
| 6,541,722 | B1 * | 4/2003 | Whipple ..... | H01H 9/0264 200/293 |
| 6,838,960 | B2 | 1/2005 | Asakawa et al. | |
| 6,936,781 | B2 | 8/2005 | Quintanilla et al. | |
| 8,853,576 | B2 | 10/2014 | Sisley et al. | |
| 2014/0251959 | A1 | 9/2014 | Fasano et al. | |

FOREIGN PATENT DOCUMENTS

| | | | |
|---|---|---|---|
| EP | 0135439 | B1 | 12/1987 |
| EP | 2728601 | A1 | 5/2014 |
| JP | H06139900 | A | 5/1994 |

* cited by examiner

SWITCHING DEVICE HAVING TERMINAL COVER, AND METHOD

CROSS-REFERENCE TO RELATED APPLICATIONS

This application is a non-provisional application and claims priority to U.S. Provisional Patent Application Ser. No. 62/129,218 filed Mar. 6, 2015 for "SWITCHING DEVICE HAVING TERMINAL COVER, AND METHOD", which is hereby incorporated by reference in its entirety.

BACKGROUND

The subject matter disclosed herein relates to switching devices, and more particularly refers to a terminal cover for a switching device.

Circuit breakers are switching devices widely used to protect electrical lines and equipment. Circuit breakers monitor current through an electrical conductor and "trip" to open the electrical circuit and thus interrupt current flow through the circuit provided that certain predetermined criteria are met, such as an over-current condition. A line side of the circuit breaker is connected to an electrical power line supplying electricity and a load side of the circuit breaker is connected to the circuit to be protected. Line and load straps extending from either the line side or load side of the circuit breaker must be connected to its source or load (such as to bus lines or cable lines). Terminals allow the circuit breaker to be connected to the source and load in a convenient way in relation to installation requirements. It is known to provide a wiring connector or lug on the terminals of the circuit breaker. The terminal lug can include a terminal lug screw used to secure a circuit breaker cable to each terminal lug. A terminal cover is sometimes fixedly attached to the circuit breaker enclosure for protection and aesthetic reasons, and is provided with the circuit breaker as a separate part with screws to attach the terminal cover to the enclosure.

BRIEF DESCRIPTION

According to one aspect, a switching device is provided. The switching device includes a housing including a base and a switching device cover coupled to the base, a line side terminal positioned on a line side of the housing, a load side terminal positioned on a load side of the housing, wherein the line side is opposite the load side, a first terminal cover coupled to the switching device cover proximate the line side, a second terminal cover coupled to the switching device cover proximate the load side, wherein the first terminal cover is movable between a closed position and an open position, wherein the first terminal cover covers the line side terminal in the closed position and provides access to the line side terminal in the open position, wherein the first terminal cover is attached to said switching device cover in both the closed and open positions, wherein the second terminal cover is moveable between a closed position and an open position, wherein the second terminal cover covers the load side terminal in the closed position and provides access to the load side terminal in the open position, and wherein the second terminal cover is attached to the switching device cover in both the closed and open positions, and a handle extending through a handle slot formed in the switching device cover, the handle disposed between the first and second terminal covers and operable to switch the switching device.

According to another aspect, a circuit breaker is provided. The circuit breaker includes a housing including a switching device cover, the housing having a line side and a load side, a terminal cover assembly including a first terminal cover coupled to the switching device cover proximate one of the line side and the load side of the housing, wherein the first terminal cover is movable between an open position and a closed position, wherein the first terminal cover covers terminals at one of the line side and the load side in the closed position, wherein the first terminal cover provides access to the terminals in the open position, and wherein the first terminal cover is attached to the switching device cover in both the open and closed positions, and a handle extending through a handle slot formed in the switching device cover, the handle disposed between the line side and the load side and operable to switch the circuit breaker.

According to yet another aspect of the invention, a method of selectively covering and accessing a terminal in a switching device is provided. The switching device includes a housing and a switching device cover coupled to the housing. The method includes coupling a first terminal cover to the switching device cover, coupling a handle to the switching device cover, the handle extending through a handle slot formed in the switching device cover, said handle disposed between a line side and a load side of the housing and operable to switch the switching device, placing the first terminal cover in a closed position to cover the terminal, and moving the first terminal cover from the closed position to an open position to access the terminal, wherein the first terminal cover is attached to the switching device cover in both the closed and open positions.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
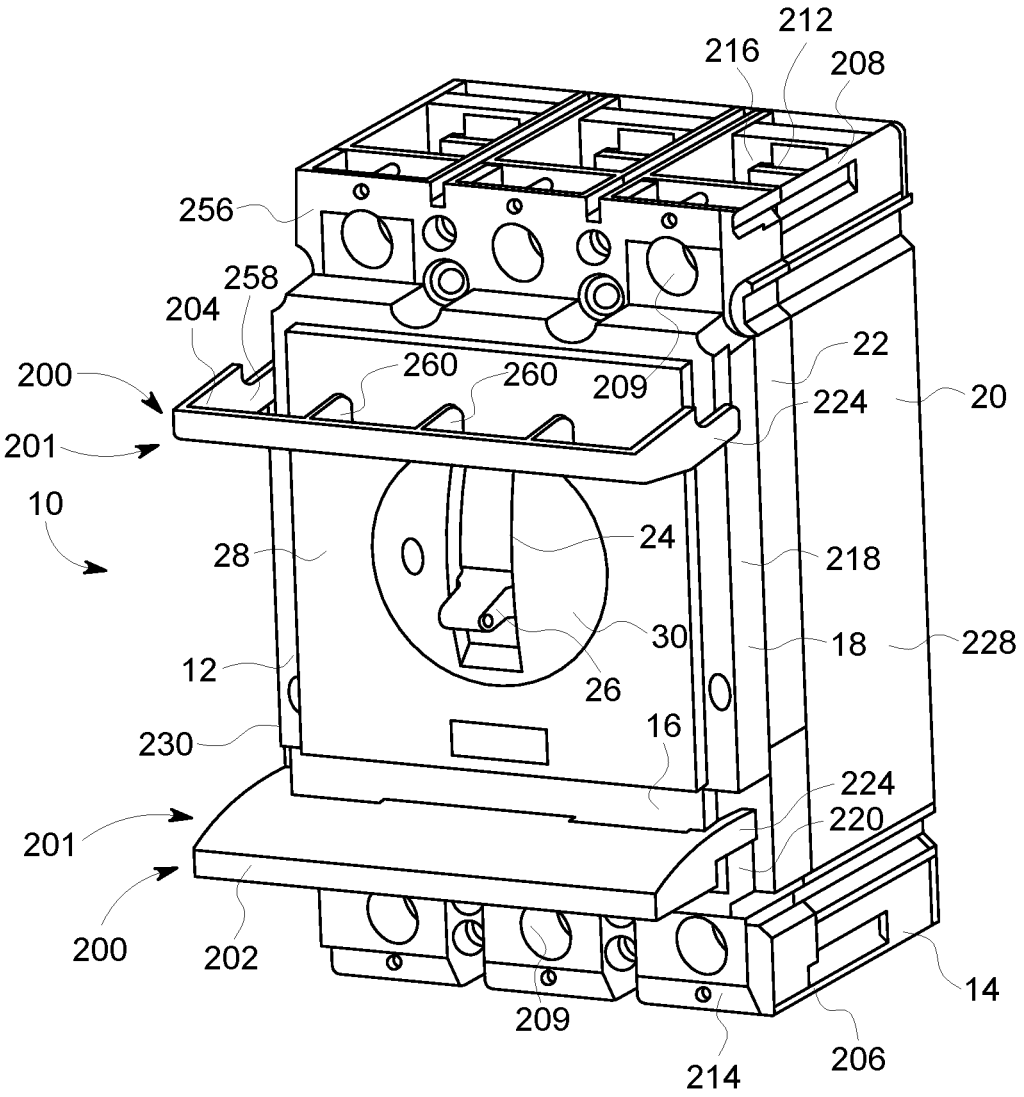
FIG. 1 is a perspective view of an embodiment of a switching device including an embodiment of terminal covers in an open position.

FIG. 1 shows one embodiment of a switching device 10 that includes an embodiment of a terminal cover 200 of a terminal cover assembly 201. In the illustrated embodiment, the switching device 10 includes first and second terminal covers 202, 204. The switching device 10 may further include an information display system 12. The illustrated switching device 10 is a circuit breaker 14, although other switching devices 10 may incorporate the terminal covers 200. While the circuit breaker 14 is illustrated as a 3 pole molded case circuit breaker ("MCCB") having a particular size and shape, other types and sizes of circuit breakers 14 and switching devices 10 can be employed, and the illustrated circuit breaker 14 is presented for illustrative purposes only. Also, while the circuit breaker 14 is illustrated as having available components 16, such as but not limited to an electronic trip unit "ETU", on a cover 18, also referred to herein as a switching device cover 18, other components 16 may be provided.

The circuit breaker 14 includes a base 20 and may further include a midcover 22 between the base 20 and switching device cover 18, and the midcover 22 and the base 20 could alternatively be combined, or the midcover 22 and the switching device cover 18 could alternatively be combined. The base 20, midcover 22, and switching device cover 18 provide a housing 188 (shown in FIG. 18) of the switching device 10. The midcover 22 may be provided with apertures 209. A handle slot 24 is provided in a fixed member 30 for allowing passage of a handle 26 of the circuit breaker 14. The switching device cover 18 may be a separable cover for removal from the base 20, such as for inspection or repair of internal components (not shown) of the circuit breaker 14. Internal components of the circuit breaker 14 may include, but are not limited to, a contact system having a set of fixed and movable contacts, movable contact arms supporting the movable contacts, an operating mechanism operating the movable contact arms, line and load straps supporting or electrically connected to fixed contacts, a current sensing unit, and arc chamber. In a normal "on" or closed condition of the circuit breaker 14, such as when the handle 26 is moved to an opposite side of the handle slot 24, the fixed and movable contacts are physically connected to each other. In an "off" or open condition of the circuit breaker 14, such as when the handle 26 is in the position shown in FIG. 1, the movable contacts are separated, such as via an opening spring, from the fixed contacts. The circuit breaker 14 thus makes or breaks the circuit based on current conditions, and may further carry rated current without over heating, provide adequate contact pressure and depression to keep the contacts closed in normal conditions, provide sufficient force to open the contact system with desired velocity during abnormal conditions, and provide dielectric isolation when contacts are in an open condition. As shown in FIG. 1, the handle 26 is disposed between the first and second terminal covers 202, 204.

The line and load straps are accessible on a line side 206 and a load side 208 of the switching device 10 at line side terminal 210 (FIGS. 10 and 11) and load side terminal 212. Additionally, any type of terminal lugs 214, 216 may be positioned at the line side 206 and load side 208 to assist in connecting the circuit breaker 14 to the source and load. Connection to the line side terminal 210 and load side terminal 212 may be achieved such as via apertures 209. Amongst the terminal covers 200, the first terminal cover 202 may be a line side terminal cover provided on the line side 206 of the switching device 10, and the second terminal cover 204 may be a load side terminal cover provided on the load side 208 of the switching device 10. For reducing costs of manufacturing, the first and second terminal covers 202, 204 may be identical.

Figure 2:
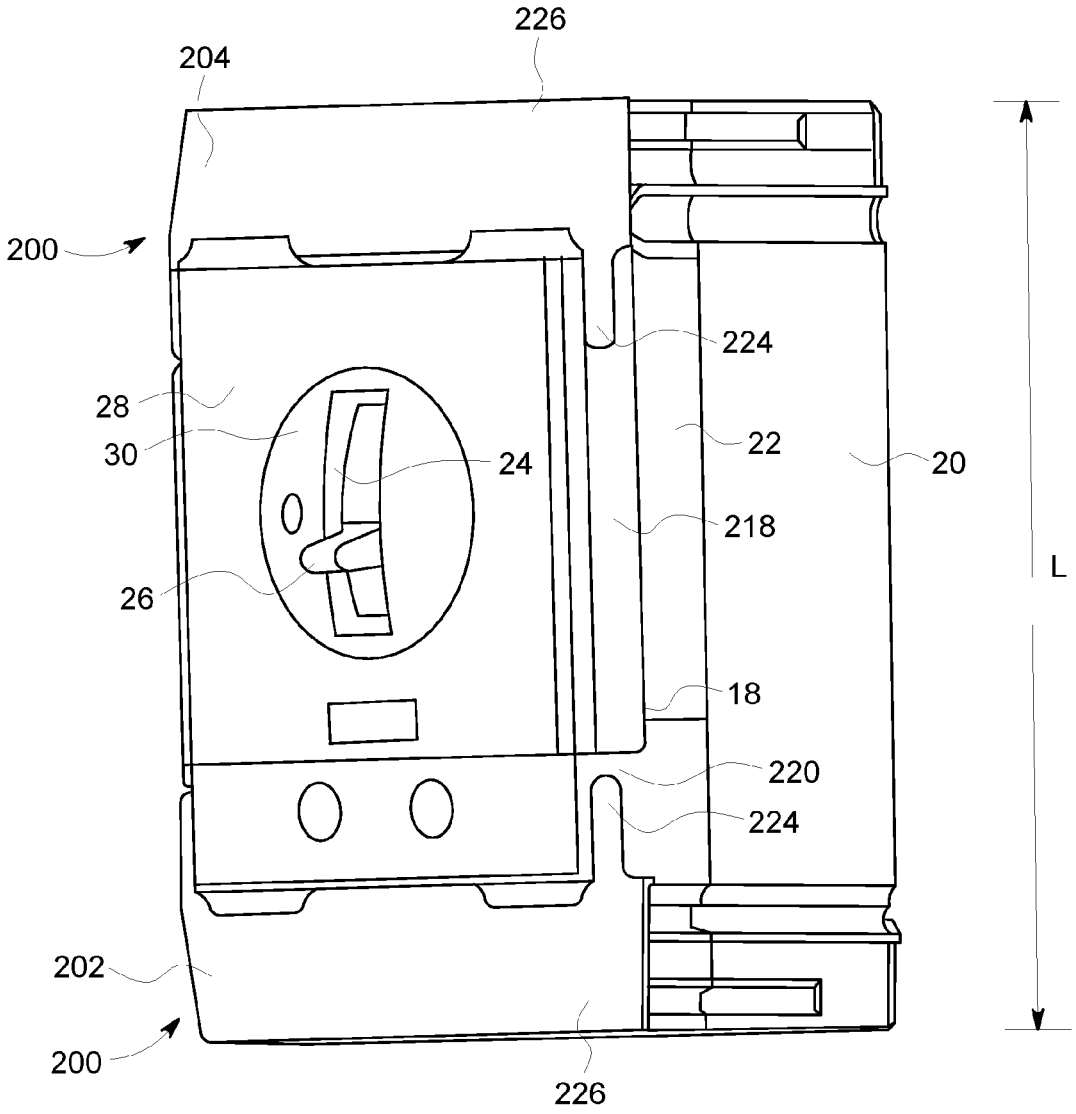
FIG. 2 is a perspective view of the switching device of FIG. 1 with the terminal covers in a closed position.
Figure 3:
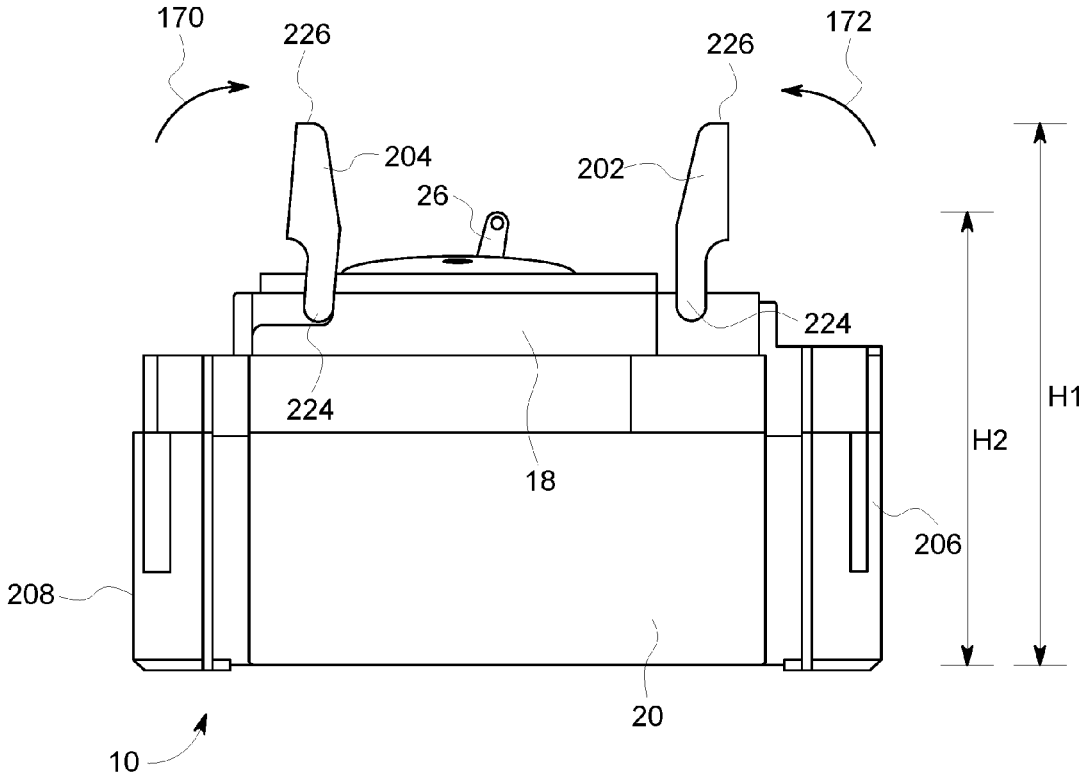
FIG. 3 is a side plan view of the switching device of FIG. 1 with the terminal covers in the open position.

The switching device cover 18 may include a first cover portion 218 and a second cover portion 220. The first cover portion 218 is included in the information display system 12 and supports the faceplate 28. The second cover portion 220, or trip unit cover portion, supports the components 16 including the ETU. The first and second cover portions 218, 220 together may complete the switching device cover 18 for the circuit breaker housing 188. While shown and described as two separate portions 218, 220, alternatively the first and second portions 218, 220 of the switching device cover 18 may be integrally combined. The terminal covers 200 of the terminal cover assembly 201 are pivotally attached to the switching device cover 18. FIG. 1 depicts the terminal covers 200 in an open position, while FIG. 2 depicts the terminal covers 200 in a closed position. As shown in FIG. 2, when the terminal covers 200 are closed, the terminal covers 200 and the switching device cover 18 substantially extend the length L of the circuit breaker housing 188. That is, a length of the base 20 is substantially equal to a combined length of the two terminal covers 200 assembled with the switching device cover 18 when the terminal covers 200 are in the closed position. Thus, when the terminal covers 200 are in the closed position, the lugs 214, 216 are covered and the terminals 210, 212 of the switching device 10 may be protected. The terminal covers 202, 204 each include a hinged portion 224 connected to the switching device cover 18 and a free end 226. The hinged portion 224 of the first terminal cover 202 is positioned between the handle 26 and the line side 206, and the hinged portion 224 of the second terminal cover 204 is positioned between the handle 26 and the load side 208. More particularly, in one embodiment, and in the closed position shown in FIG. 2, the hinged portion 224 of the first terminal cover 202 is positioned between the handle 26 and the free end 226, and the hinged portion 224 of the second terminal cover 204 is positioned between the handle 26 and the free end 226. When arranged in this manner, and as shown in FIGS. 1 and 3, when the terminal covers 202, 204 are in an open position to provide an operator access to the lugs 214, 216 on the line side 206 and the load side 208, the terminal covers 202, 204 at least partially block access to the handle 26. That is, when in the open position, the terminal covers 202, 204 form temporary walls with the handle 26 positioned between the temporary walls so that while an operator is working on the line side 206 or the load side 208, the handle 26 is not inadvertently shifted from an off position to an on position. In an embodiment, a height H1 of the terminal covers 202, 204 in an open position, as measured from the bottom of the base 20 to the free end 226, is greater than a height H2 of the handle 26 as measured from the bottom of the base 20 to an outer end of the handle 26, as shown in FIG. 3, thus further shielding the handle 26 between the terminal covers 202, 204, when in the open position.

Figure 4:
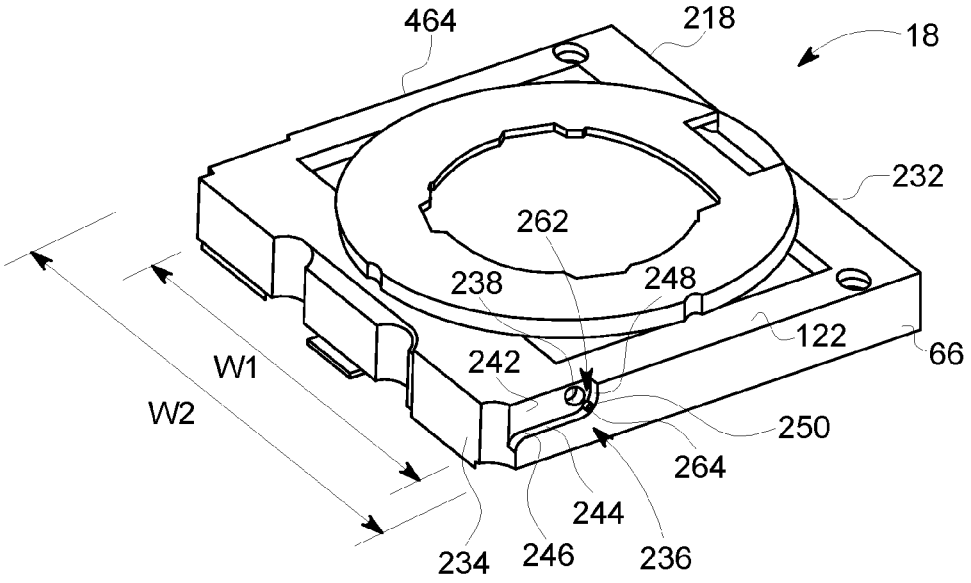
FIG. 4 is a perspective view of an embodiment of a switching device cover for the switching device of FIG. 1.
Figure 5:
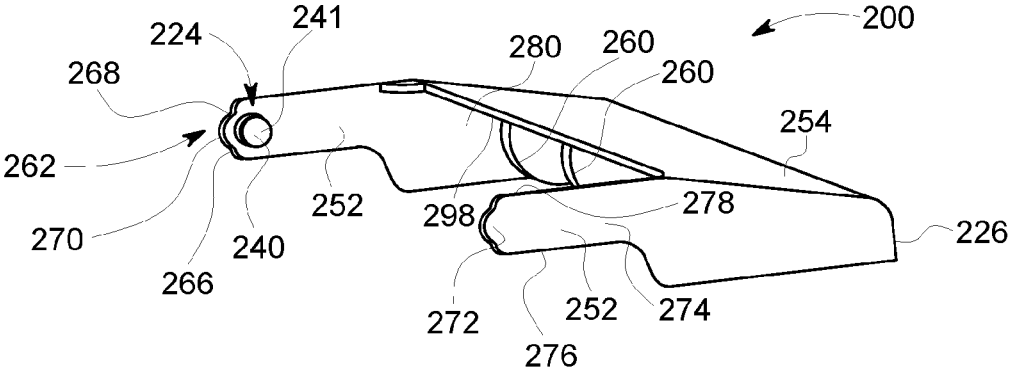
FIG. 5 is a perspective view of the terminal cover for the switching device of FIG. 1.
Figure 6:
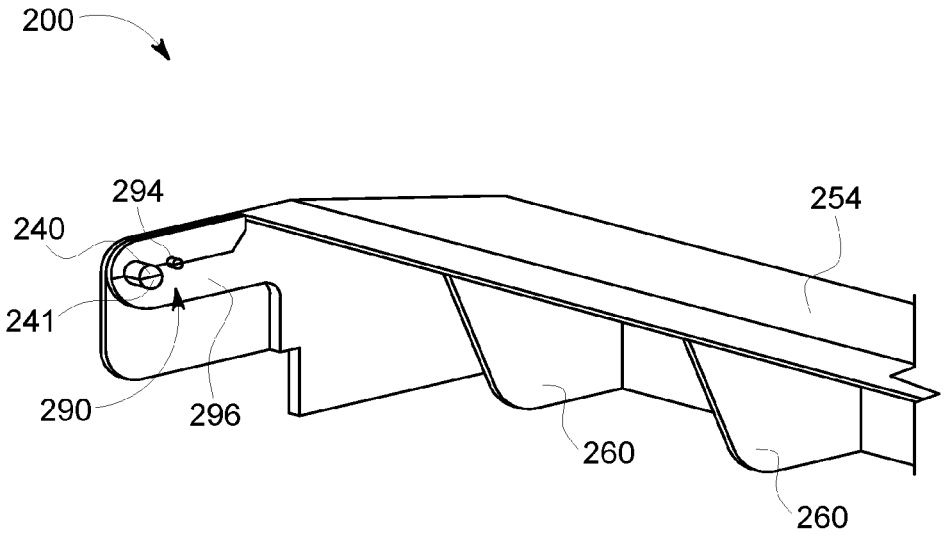
FIG. 6 is a perspective view of a portion of an alternate embodiment of a terminal cover.

With reference to FIG. 4, additional details of an embodiment of the switching device cover 18, and more particularly the first cover portion 218, are shown. With reference to FIG. 5, additional details of an embodiment of the terminal cover 200 are shown. The details shown for the terminal cover 200 may be identical in either terminal cover 202, 204. The first cover portion 218 includes first and second opposite sides 64, 66, corresponding to first and second opposite sides 228, 230 (FIG. 1) of the switching device 10. The first cover portion 218 also includes third and fourth opposite sides 232, 234, which may extend substantially parallel to the line side 206 and load side 208 of the switching device 10. The first and second opposite sides 64, 66 may each include a hinge area 236 for pivotally connecting to the hinged portion 224 of the terminal covers 200. The hinge area 236 of the switching device cover 18 is illustrated as including an aperture or recess 238 for receiving a pivot protrusion 240 of the terminal covers 200, however in an alternative embodiment the switching device cover 18 may include a pivot protrusion and the hinged portion 224 of the terminal covers 200 may include an aperture or recess sized to receive the pivot protrusion of the switching device cover 18. The location of the pivot protrusion 240 serves as a pivot point 241 for the terminal covers 200. The hinge area 236 of the switching device cover 18 is provided in an indented section 242 indented from the first and second opposite sides 64, 66, such that a width W1 of the switching device cover 18 from the indented section 242 on the first side 64 to the indented section 242 on the second side 66 is less than a width W2 of the switching device cover 18 from the first and second opposite sides 64, 66. A ridge 244 extends at an angle, such as perpendicularly, from the indented section 242 to the sides 64, 66. The ridge 244 may include a first part 246 substantially parallel to the exterior surface 122 of the switching device cover 18, and a second part 248 substantially perpendicular to the first part 246. The transition area 250 between the first part 246 and the second part 248 is substantially rounded.

The terminal covers 200 include fingers 252 receivable within the indented sections 242 and having the hinged portion 224. The terminal covers 200 further include a cover panel 254 sized to adequately cover the lugs 214, 216 on the line and load sides 206, 208 of the switching device 10. Although the cover panel 254 need not be planar, the fingers 252 may extend substantially perpendicularly from the cover panel 254 such that, in a closed position of the terminal covers 200, the cover panel 254 extends across at least a portion of a top surface 256 (FIG. 1) of the switching device 10, and the fingers 252 extend along sides 228, 230 of the switching device 10. In an embodiment, an interior surface 258 of the terminal covers 200 may further include a plurality of baffles 260.

A latching system 262 to at least temporarily lock and selectively hold the terminal cover 200 in an open or closed position as desired may be further provided. The latching system 262 may include a latching protrusion 264 on the switching device cover 18 located at the transition area 250 between the first part 246 and the second part 248 of the ridge 244. The latching system 262 may further include first and second latching detents 266, 268, with a latching cam 270 interposed between the first and second latching detents 266, 268, provided at the end 272 of the fingers 252 of the terminal covers 200. The fingers 252 of the terminal covers 200 may be sized to fit within the indented sections 242 of the switching device cover 18. For example, when the pivot protrusions 240 of the fingers 252 are received within the apertures 238 of the switching device cover 18, and the terminal covers 200 are in a closed position, an exterior surface 274 of the fingers 252 may be substantially flush with an exterior surface of the sides 64, 66. The fingers 252 further include a first edge 276 and a second edge 278, with the first edge 276 extending from the first latching detent 266 and the second edge 278 extending from the second latching detent 268. In the closed position of the terminal covers 200, the latching protrusion 264 of the switching device cover 18 is seated within the first latching detent 266 and the first edge 276 of the fingers 252 interfaces with the first part 246 of the ridge 244. Also in the closed position, the latching cam 270 and the second latching detent 268 are positioned adjacent the second part 248 of the ridge 244. The latching cam 270 can prevent the terminal cover 200 from being accidentally opened or from opening due to gravity if the switching device is vertically mounted, however, when access to the terminal lugs 214, 216 is desired, the terminal cover 200 can easily be pivoted about the hinge area 236. The latching cam 270 will ride over the latching protrusion 264 until the second latching detent 268 rests on the latching protrusion 264, with the latching protrusion 264 nested within the second latching detent 268. In the open position, the terminal cover 200 will be prevented from falling back to a closed position by the latching system 262. In one embodiment, the fingers 252 extend substantially perpendicularly to the switching device 10 in the open position, by pivoting approximately 90 degrees in a clockwise or counterclockwise direction, for maximizing the space for an operator to work, however other opening angles are possible. The first and second terminal covers 202 and 204 are connected to the switching device cover 18 such that movement to an open position from a closed position will require movement in first and second rotational directions 170, 172, where the second direction 172 is opposite the first direction 170. Due to the latching system 262, an operator can work on the terminal lugs 214, 216 until it is desired to close the terminal covers 200 again. Further, because the terminal covers 200 do not need to be detached from the housing 188 in order to access the terminals 210, 212, the chance of losing the terminal covers 200 is greatly reduced.

The terminal covers 200 and the switching device cover 18 may be formed of a durable plastic suitable for use in the switching device 10. In one embodiment, the plastic employed may be the same type as used for the remainder of the housing 188 of the MCCB 14. The inherent flexibility of the material used for the switching device cover 18 and terminal covers 200 may assist in enabling the latching system 262 to perform the task of retaining the terminal cover 200 in either the closed position or open position relative to the switching device cover 18. While the terminal covers 200 are advantageously retained on the switching device cover 18 even during the open position, it may further be possible to remove the terminal covers 200 from the switching device 10 if needed or desired.

The terminal covers 202 and 204 may be identical, and therefore the second cover portion 220 may include the same or substantially the same indented section 242 with ridge 244, hinge area 236, and latching protrusion 264 as the first cover portion 218 shown in FIG. 4. Additionally, the terminal covers 200 may include a reflective surface 280 on the interior surface 258 of the terminal covers 200 such that light coming from the ETU 16 or additional light, such as from a liquid crystal display ("LCD") or an additional light emitting diode ("LED") on the trip unit cover 220 or coming from the operator can be reflected back on the terminal lugs 214, 216 when the terminal covers 200 are in the open position to assist the operator in a dark environment.

Figure 7:
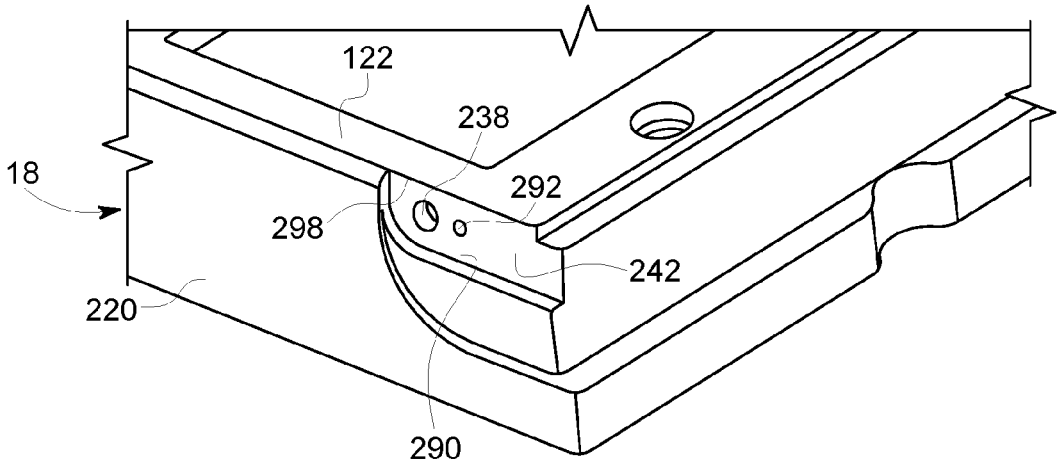
FIG. 7 is perspective view of a portion of an alternate embodiment of a switching device cover.
Figure 8:
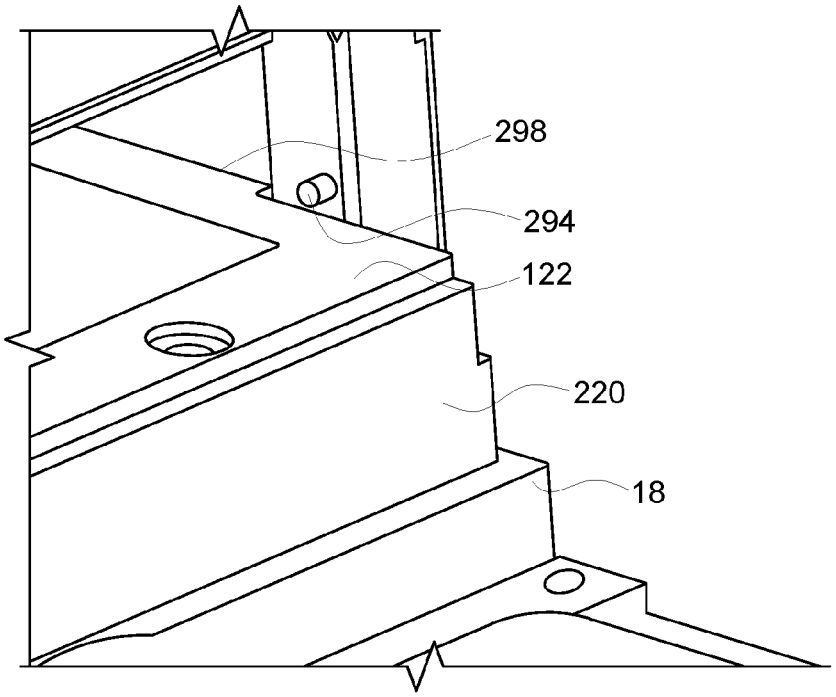
FIG. 8 is a perspective of the terminal cover of FIG. 6 attached to the switching device cover of FIG. 7, with the terminal cover in an open position.
Figure 9:
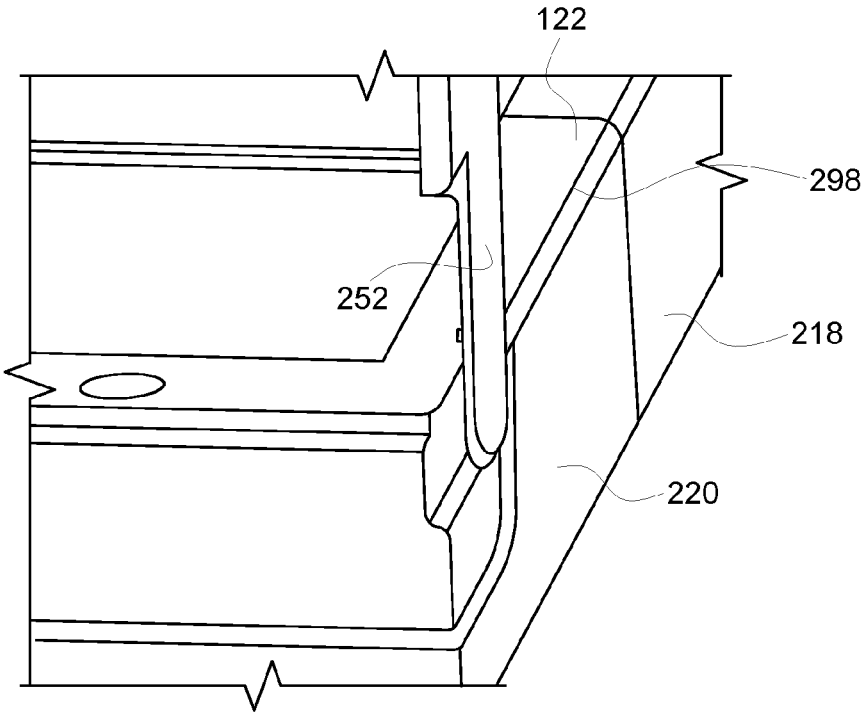
FIG. 9 is another perspective view of the terminal cover of FIG. 6 attached to the switching device cover of FIG. 7, with the terminal cover in an open position.
Figure 10:
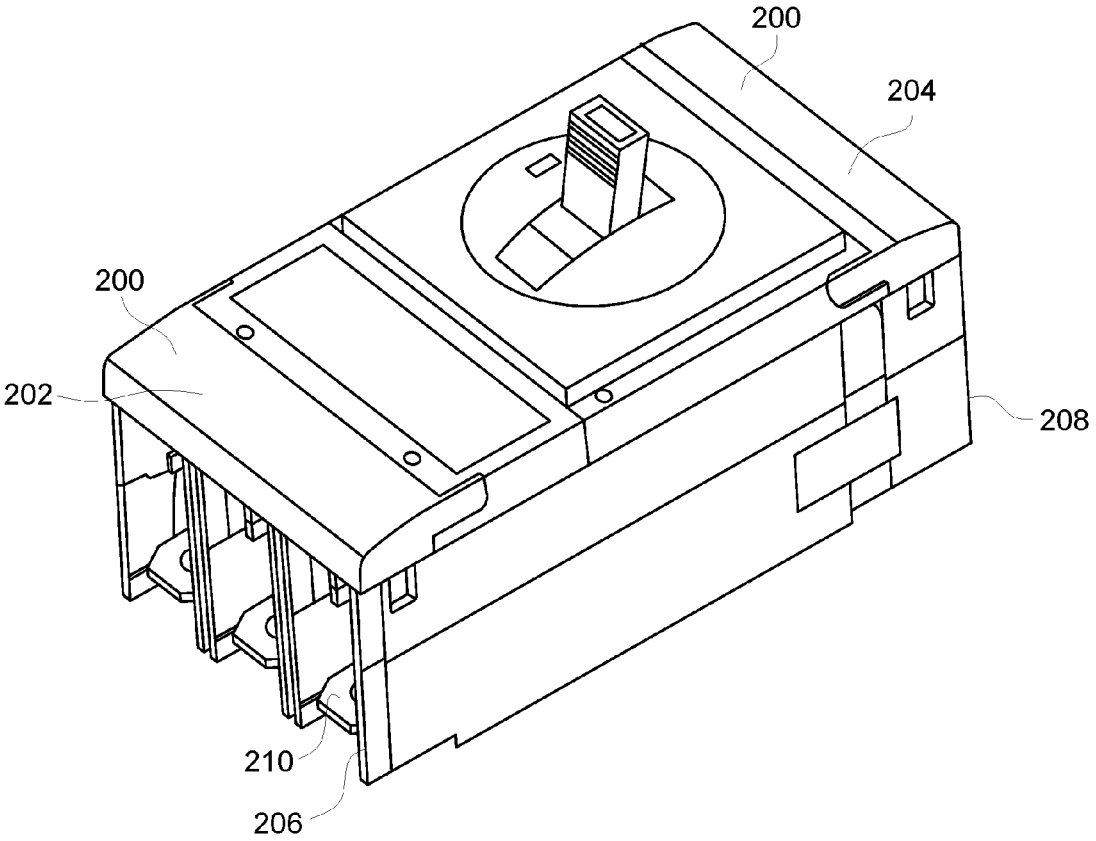
FIG. 10 is a perspective view of an embodiment of a switching device including terminal covers of FIG. 6 and the switching device cover of FIG. 7, with the terminal covers in a closed position.
Figure 11:
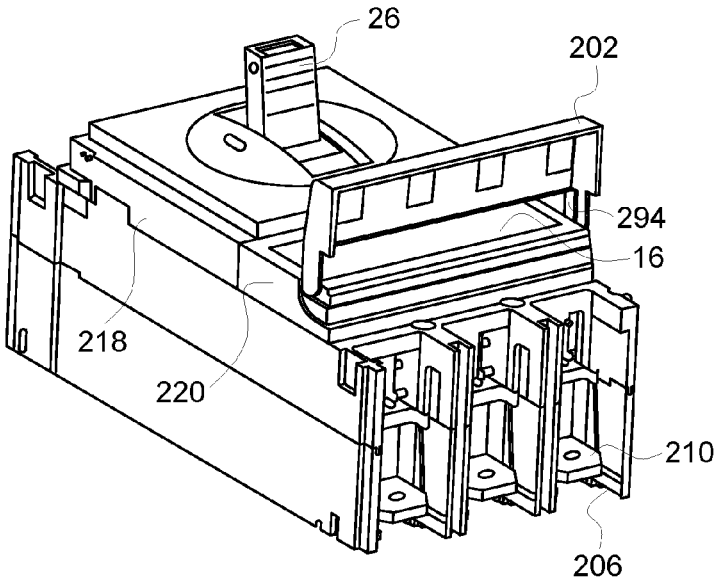
FIG. 11 is a perspective view of the switching device of FIG. 10 including the terminal cover of FIG. 6 and the switching device cover of FIG. 7, with one terminal cover in an open position and one terminal cover removed.

Turning now to FIGS. 6-11, another embodiment of a latching system 290 for a terminal cover 200 for the switching device 10 is shown, where like elements or substantially like elements are shown with the same reference numerals. FIG. 7 shows a second cover portion 220 containing the latching system 290, however it should be understood that the first cover portion 218 can contain the same latching system 290, and therefore the second cover portion 220 will be referred to as the switching device cover 18. The indented section 242 includes a latching recess 292 sized to receive a latching protrusion 294, such as a latching post, on an interior surface 296 of the fingers 252 of the terminal cover 200 when the terminal cover 200 is in the closed position, as shown in FIG. 10. The terminal covers 200 can be rotated to the open position shown in FIGS. 8, 9, and 11 by rotating the terminal covers 200 about the pivot point 241 of the hinged portion 224 forcing the latching protrusion 294 out of the latching recess 292. The latching protrusion 294 will be pushed against the indented section 242, pushing the fingers 252 slightly outwardly and creating interference tension, until the terminal covers 200 are in the fully open position (FIGS. 8, 9, and 11). When in the fully open position, the latching protrusion 294 can return the fingers 252 to a biased position (no longer flexed outwardly) and the latching protrusion 294 will rest against the exterior surface 122 of the switching device cover 18. At the moment the latching protrusion 294 passes the edge 298 of the switching device cover 18, an operator may feel a positive snap. The latching protrusion 294 enables the terminal covers 200 to be latched in the open position, preventing the terminal covers 200 from freely falling back onto the terminal lugs 214, 216, thus providing ample space for an operator to work on the terminal lugs 214, 216 during maintenance. When closing the terminal covers 200, the operator may be provided with the same positive snap feeling when the latching protrusion 294 re-enters the latching recess 292 in the indented section 242 of the switching device cover 18. The positive latching system 290 prevents the terminal covers 200 from opening due to gravity, particularly on one side of the switching device 10, such as but not limited to the line side 206 of the switching device 10 when vertically mounted in a panel. Without the latching system 290, or the previously described latching system 262 or other terminal cover latching system, the terminal cover 200 may have a tendency to open about the hinged portion 224 when the switching device 10 is mounted vertically in the panel. Also, as with the prior embodiment, the terminal covers 200 may be removable and FIG. 11 demonstrates an embodiment where one terminal cover 204 has been removed. Alternatively, the terminal covers 200 may be integrally attached to the switching device 10.

A method of covering and accessing the terminal 210 in the switching device 10 includes attaching the first terminal cover 202 to the housing 188 of the switching device 10 about a hinge area 236; covering the terminal 210 with the first terminal cover 202 in the closed position of the first terminal cover 202; and, accessing the terminal 210 by pivoting the first terminal cover 202 to the open position. The aesthetic terminal covers 200 are rotational to hide the lugs 214, 216 and provide a finished look when installed. The customer does not have to remove the covers 200 to access lugs 214, 216, however, if needed, the terminal covers 200 can be removed from the switching device 10 since the terminal covers may be mounted with a pivot protrusion 240 that may be retained with the help of self-retention force of plastic. Latching systems, such as but not limited to the latching systems 262, 290, may be added so the terminal covers 200 can be latched open, providing the full space for the operator to work on the lugs 214, 216 without the terminal covers 200 falling in the way of maintenance. The switching device with terminal covers 200 avoids the requirement of separate parts or sub-assemblies, and no screws, other attachment devices, or hardware are required. Also, the switching device with terminal covers 200 reduces the possibility of losing the terminal cover 200 or misapplying the terminal cover 200 by the user because the terminal cover 200 can be provided as an integral part of the switching device 10. The terminal cover 200 can also be the same for the line and load sides 206, 208, thus reducing manufacturing expenses. The terminal cover 200 is easy to operate, and the latching systems 262, 290 provide more ingress protection for users from live parts. The arrangement of the terminal covers 200 further avoids accidental operation of the handle 26 when tightening cables via the lugs 214, 216.

Figure 12:
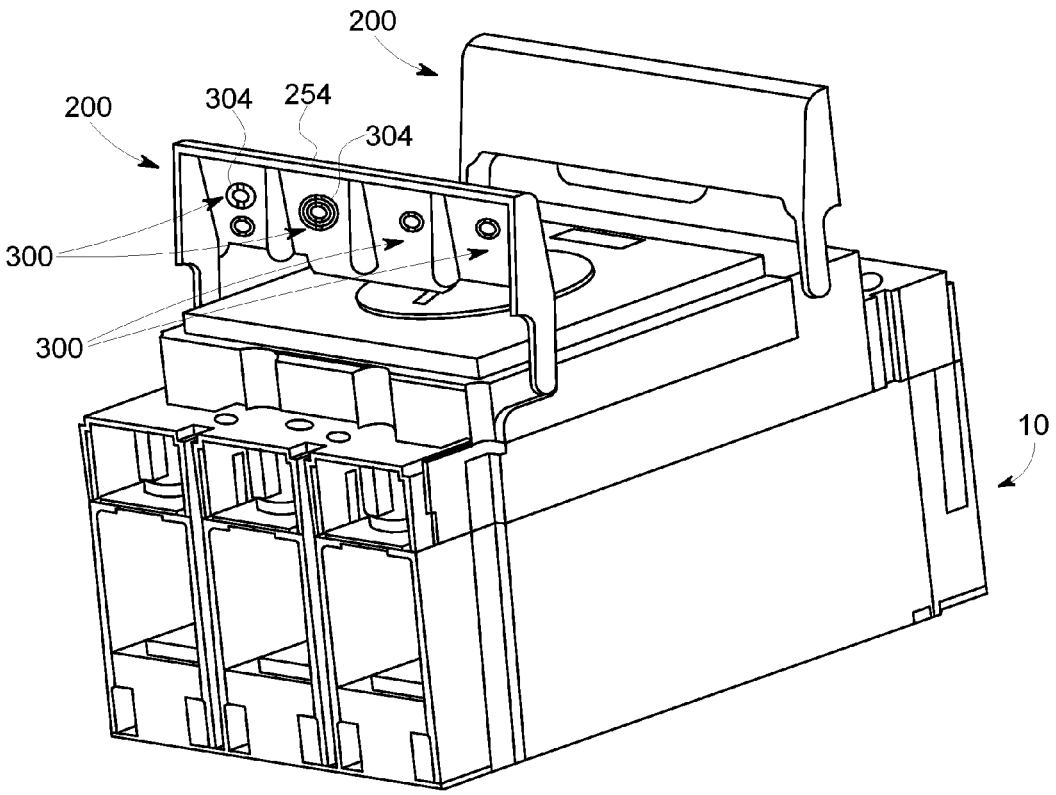
FIG. 12 is a perspective view of an embodiment of a switching device including an embodiment of terminal covers in an open position.
Figure 13:
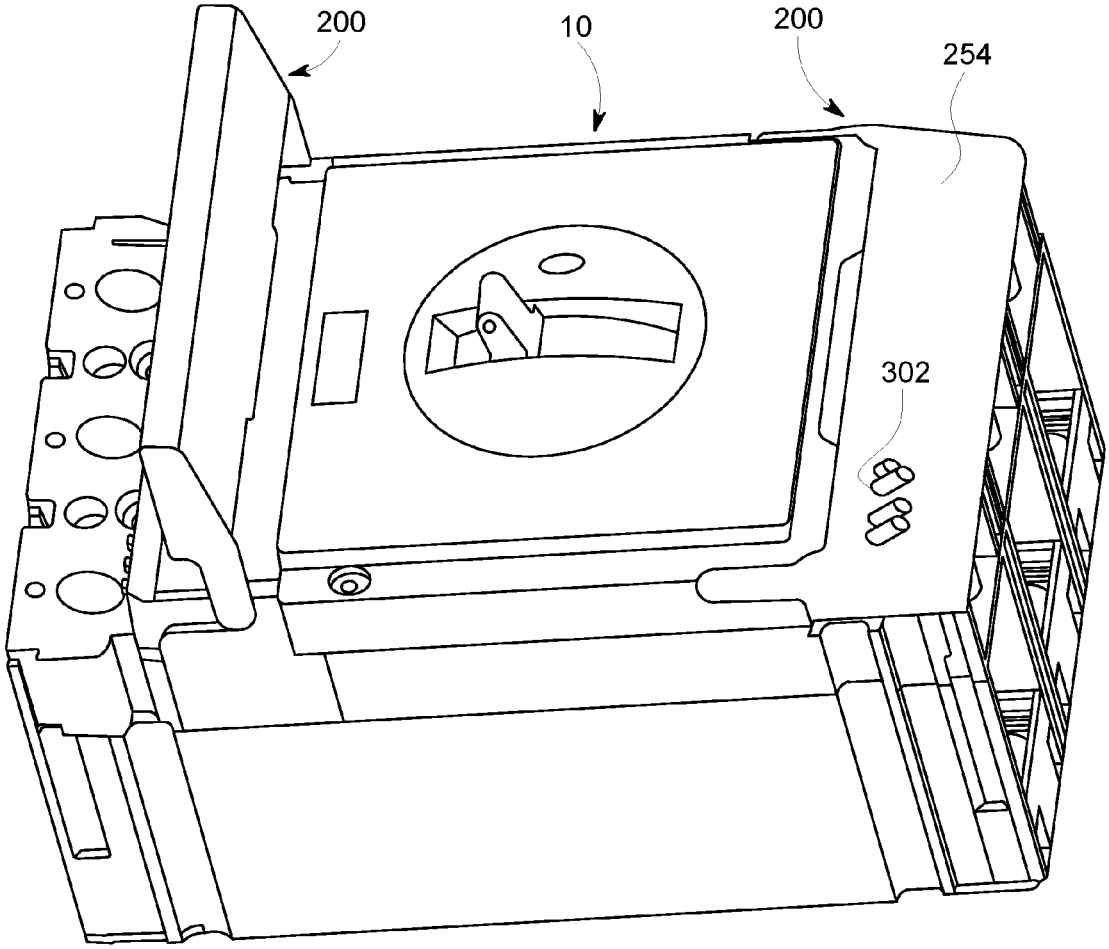
FIG. 13 is a perspective view of the switching device of FIG. 12 with one terminal cover in an open position and one terminal cover in a closed position.
Figure 14:
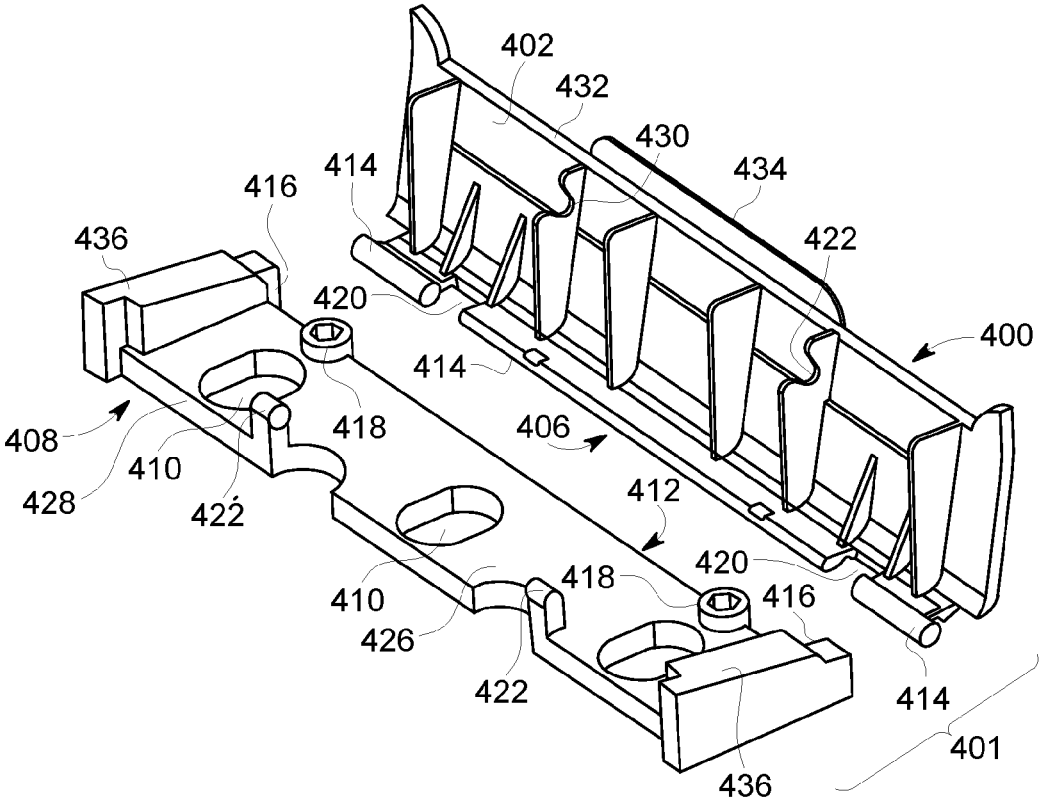
FIG. 14 is an exploded perspective view of an alternate embodiment of a terminal cover assembly.
Figure 15:
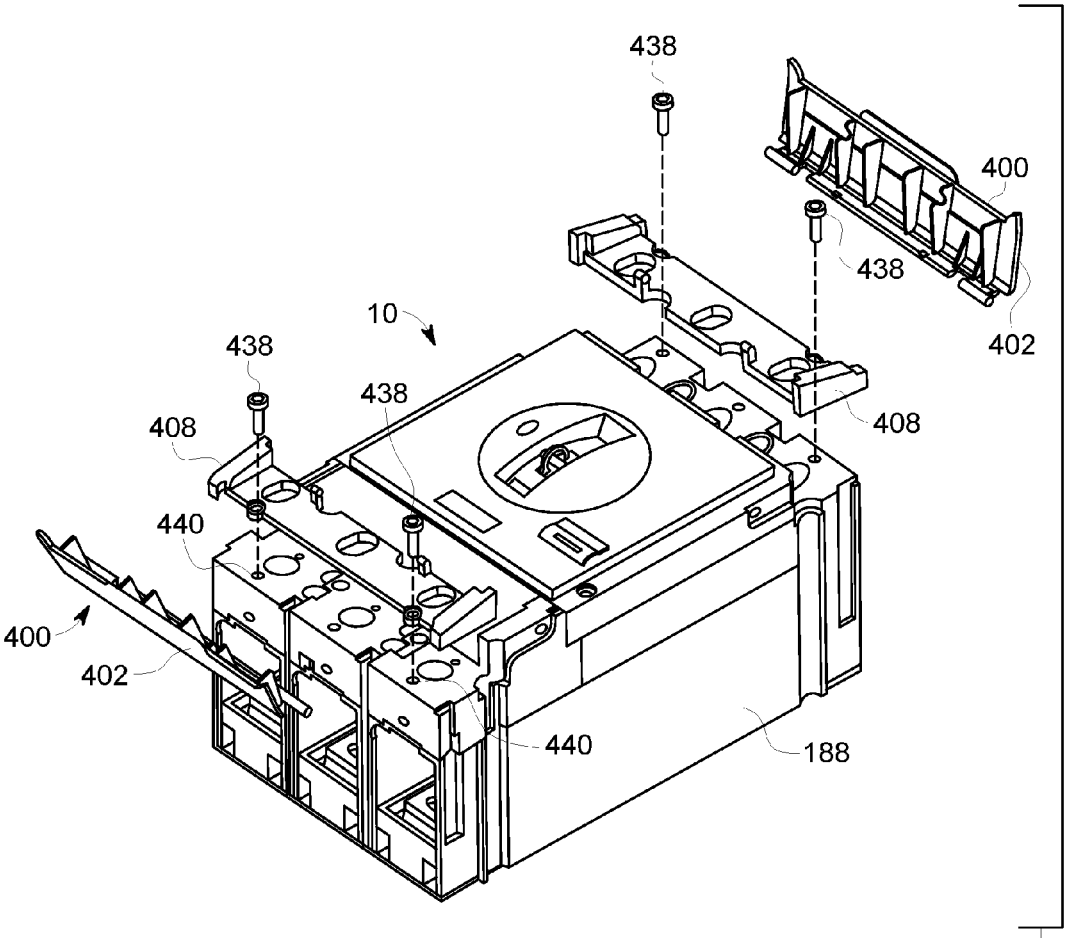
FIG. 15 is a partially exploded perspective view of an embodiment of a switching device with the terminal cover assembly of FIG. 14 prior to assembly on the switching device.

With reference now to FIGS. 12 and 13, the terminal covers 200 may include one or more knockouts 300, such as in the cover panel 254, to route one or more accessory wires 302 (shown in FIG. 13) to or from the switching device 10. The knockouts 300 may have any size or shape, and may, prior to being knocked out, include a partially stamped opening, such as knockout ring 304, through the cover panel 254. Several knockouts 300 may be provided along the cover panel 254 so that an operator can select the knockout 300 that is most convenient to pass the accessory wires 302. Also, one or more or the knockouts 300 may include one or more nested or concentric knockout rings 304 so that a correct size for one or more of the accessory wires 302 can be chosen. If required, a user can remove or "knock out" a conveniently located and suitably sized knockout 300. Removal of the knockout 300 may be simplified by moving the terminal covers 200 to the open position shown in FIG. 12.

Figure 16:
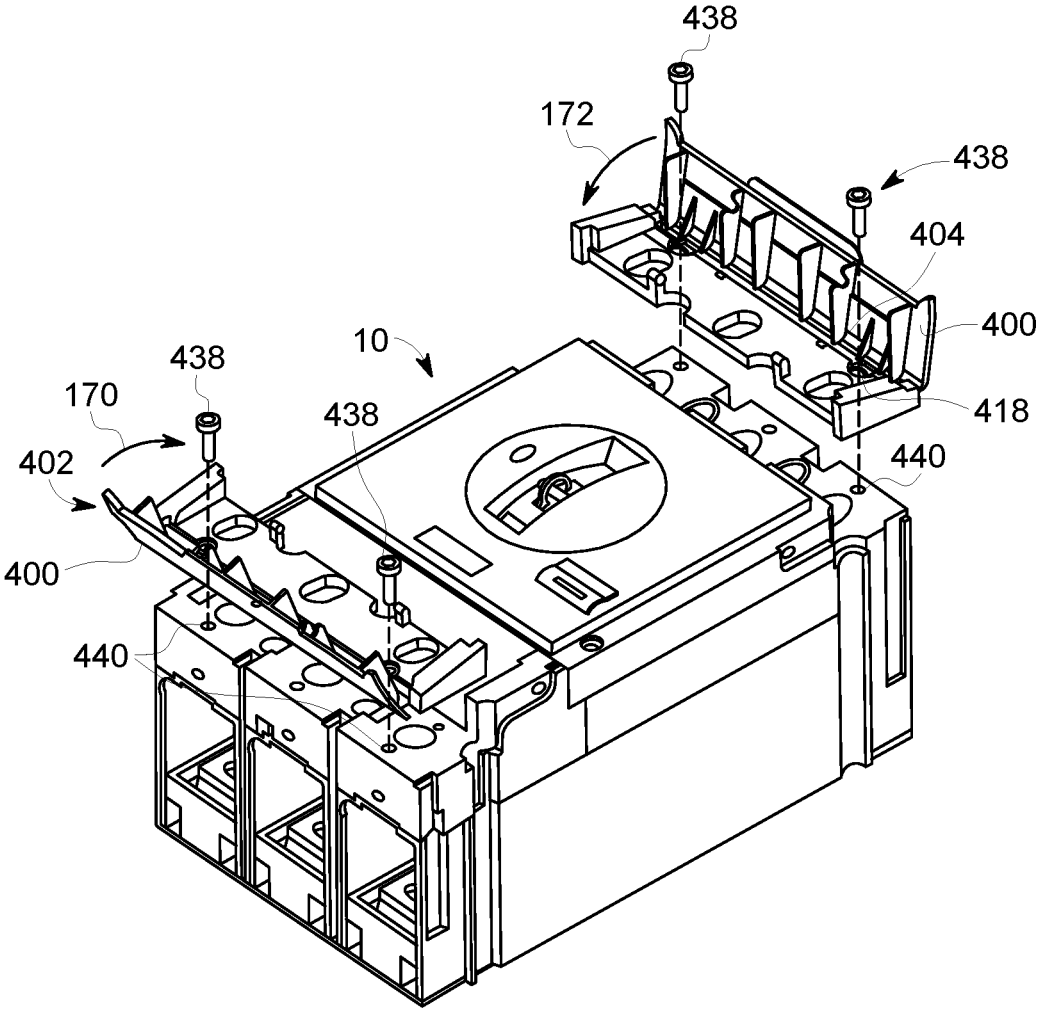
FIG. 16 is a partially exploded perspective view of the switching device of FIG. 15 with the terminal cover assembly of FIG. 14 assembled but not attached to the switching device.
Figure 17:
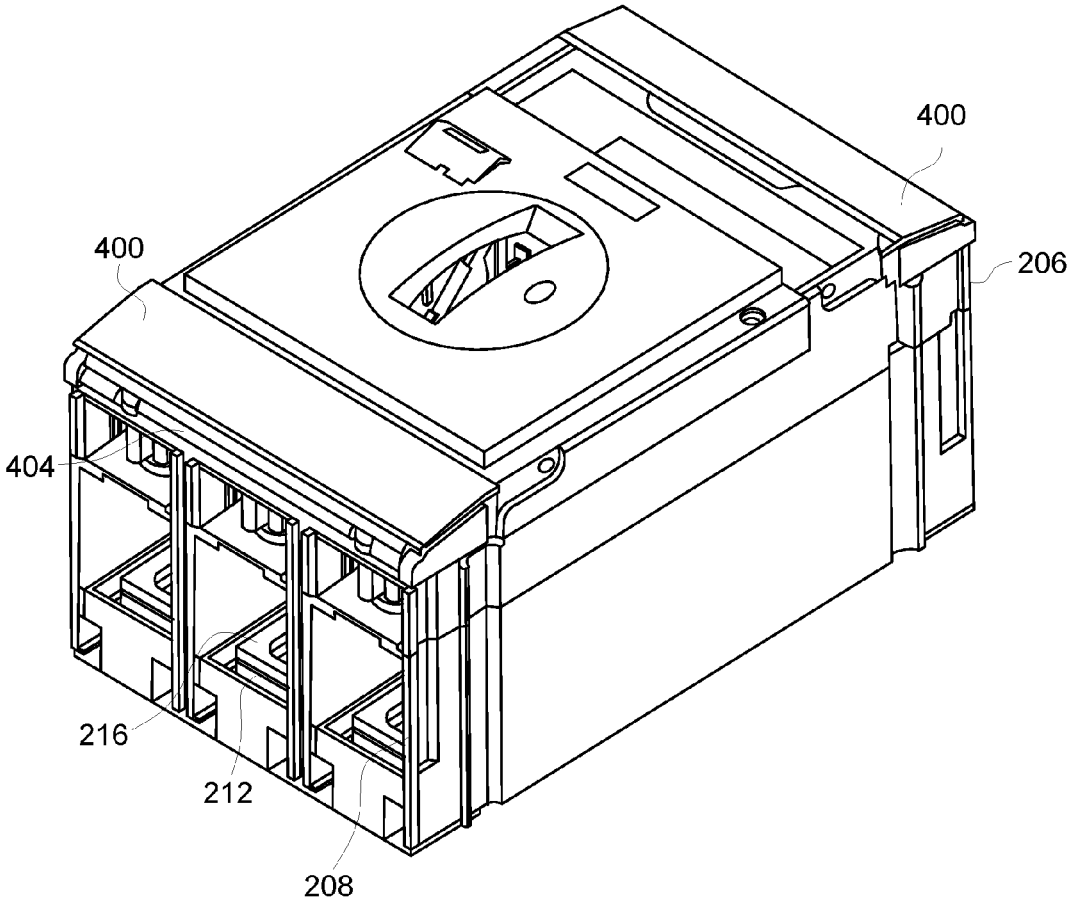
FIG. 17 is a perspective view of the switching device of FIG. 15 including the terminal cover assembly of FIG. 14 attached thereon and the terminal cover in a closed position.

Turning now to FIGS. 14-17, another embodiment of a terminal cover 400 for the switching device 10 is shown as part of a terminal cover assembly 401. As in the previous embodiments, this embodiment of the terminal cover 400 employs a hinged cover panel 402 that is pivotal with respect to the housing 188 of the switching device 10. The hinged cover panel 402 may also include knockouts 300 as previously described with respect to the terminal cover 200 shown in FIGS. 12 and 13. This embodiment, however, may differ from previous embodiments in that a hinge 404 (FIG. 16) extends along a first longitudinal side 406 of the cover panel 402. An aperture plate 408 of the terminal cover assembly 401 may further be provided that includes apertures 410 alignable with apertures 209 in the midcover 22 when the terminal cover is installed on the switching device 10. In lieu of the apertures 209 in the midcover 22, the apertures 410 may provide direct access to the terminals 210, 212 and any lugs 214, 216 connected to the terminals 210, 212. The aperture plate 408 includes a first longitudinal side 412 for the hinge 404. When assembled, the first longitudinal side 406 of the cover panel 402 and the first longitudinal side 412 of the aperture plate 408 extend substantially parallel to the line side 206 and load side 208. The hinge 404 may include at least one pin 414 extending along at least a portion of the first longitudinal side 406. In the illustrated embodiment, two end pins 414 on ends of the cover panel 402 are provided, and the embodiment may further include a central pin 414. The aperture plate 408 includes a mating profile 416 cut along the first longitudinal side 412 for receiving the pin or pins 414 of the cover panel 402. Together, the profile 416 of the aperture plate 408 and the pin or pins 414 of the cover panel 402 form a hinge 404 of the terminal cover assembly 401. In an alternate embodiment, a pin may be provided on the aperture plate 408 and a mating profile may be provided on the cover panel 402 to form the hinge 404 that extends along the first longitudinal sides 406, 412 of the cover panel 402 and aperture plate 408. The aperture plate 408 may include one or more screw holes 418 (two shown) for securing the aperture plate 408 to the housing 188, and the cover panel 402 may be provided with notches 420 to accommodate the screw holes 418. In the illustrated embodiment, the screw holes 418 are provided along the first longitudinal side 412 of the aperture plate 408. The terminal cover assembly 401 further includes a latching mechanism 422 to latch the terminal cover 400 in a closed position as shown in FIG. 17. As illustrated, the latching mechanism 422 may include a latching protrusion 424, such as a latching pin, protruding from an exterior surface 426 of the aperture plate 408 adjacent a second longitudinal side 428 of the aperture plate 408, and the cover panel 402 may further include a latching recess 430, such as a mating profile, cut adjacent a second longitudinal side 432 of the cover panel 402, with the latching protrusion 424 press-fitted into the latching recess 430 in the closed position. The second longitudinal side 432 of the terminal cover 400 may further include a lip 434 to assist a user in moving the cover panel 402 to an open position. The aperture plate 408 may include end ramps 436 and the cover panel 402 may be corresponding ramped to provide a substantially smooth outer surface of the switching device 10 when the terminal cover 400 is in the closed position. As shown, line side and load side terminal cover assemblies 401 may be substantially the same, and may further be identical for reducing manufacturing expenses.

The terminal cover 400 may be secured to the aperture plate 408 to form the terminal cover assembly 401 prior to assembling onto the switching device 10, as shown in FIG. 16. With the terminal cover 400 in an open position, screws 438 may be passed through the screw holes 418 in the aperture plate 408 into corresponding screw holes in the housing 188 to secure the terminal cover assembly 401 to the housing 188. When the terminal cover 400 is closed, the screws 438 may be substantially hidden from a top view of the switching device 10 as shown. While a screw-connection is described, the terminal cover assembly 401 may be alternately secured to the housing 188. For illustrative purposes, the terminal covers 400 are shown assembled with respect to the switching device 10 in such a manner that the terminal covers 400 rotate away from the handle 26 in an open position, as opposed to towards the handle 26 in the open position as in the previous embodiments. While not protecting the handle 26 from accidental movement as in the previous embodiments, the illustrated arrangement of terminal covers 400 on the switching device 10 still provides for a terminal cover 400 that remains attached to the switching device 10 in both open and closed positions of the terminal cover 400. Also, because the terminal covers 400 are hinged at the line side 206 and load side 208, the terminal covers 400 can flap open towards the line side 206 and load side 208 in the open position and thus not be in the way when an operator is accessing the terminals 210, 212 through the apertures 209 in the housing 188. Nonetheless, while the terminal covers 400 are shown assembled with the hinges 404 along the line side 206 and load side 208, in an alternative embodiment, the terminal covers 400 may be assembled onto the housing 188 in a 180 degree repositioning such that the second longitudinal sides 428, 432 are instead adjacent the line side 206 and load side 208 and the terminal covers 400 pivot towards the handle 26 in the open position. While the terminal covers 400 are disclosed as opening in opposite rotational directions 170, 172, the first and second terminal covers 400 may be arranged such that they open in a same rotational direction. Further, while the terminal cover assemblies 401 are described as having the aperture plate 408, the housing 188 may alternatively be molded or otherwise provided with the cooperating features for the hinge 404 and latching mechanism 422 so that the terminal cover 400 may be directly secured to the housing 188 in lieu of utilizing the aperture plate 408.

Figure 18:
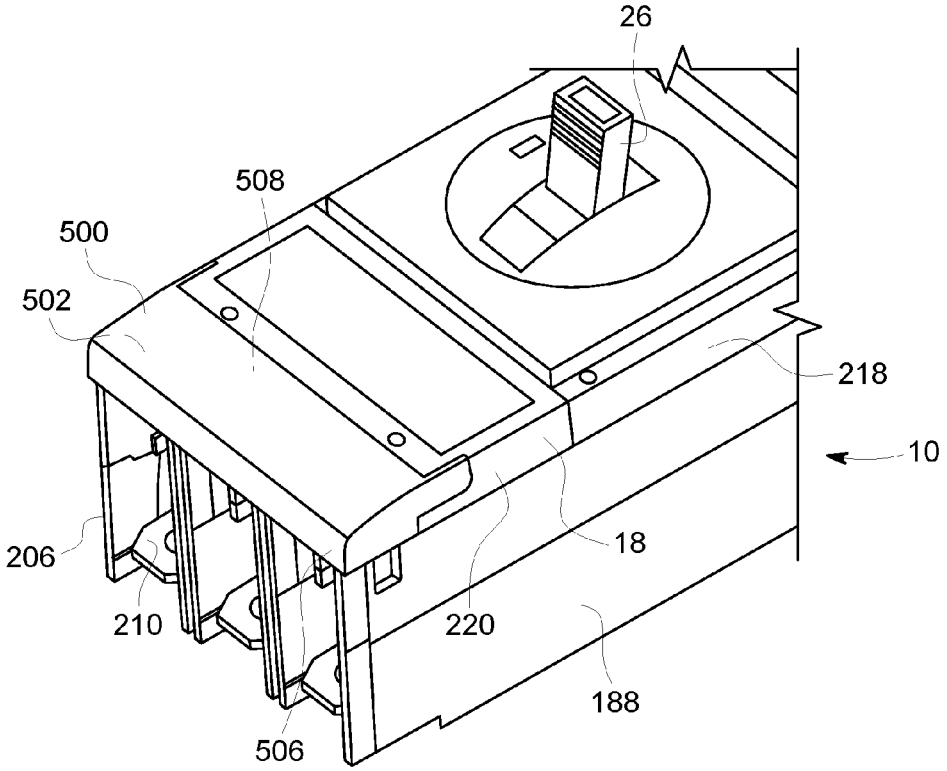
FIG. 18 is a perspective view of an embodiment of a switching device including an alternate embodiment of a terminal cover in a closed position.
Figure 19:
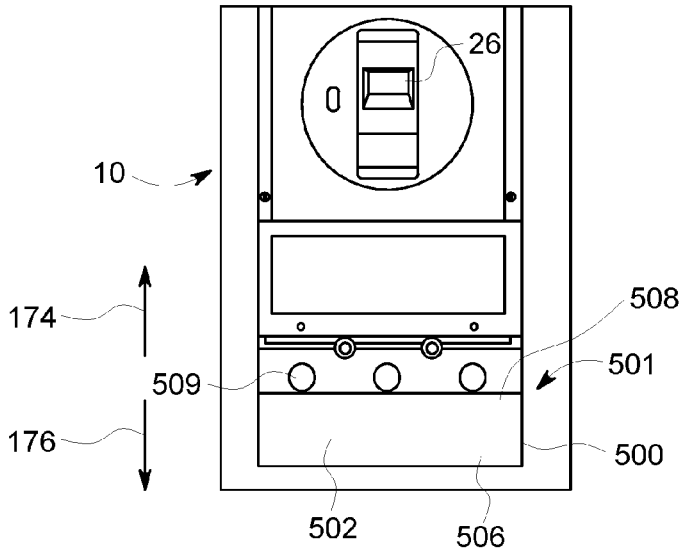
FIG. 19 is a top plan view of the switching device of FIG. 18 with the terminal cover in an open position.

With reference now to FIGS. 18-23, another embodiment of terminal covers 500 of a terminal cover assembly 501 for the switching device 10 is shown. Instead of a pivoting movement, such as in the previously described rotational directions 170, 172 shown in FIGS. 3 and 16, the terminal covers 500 move between the closed position shown in FIG. 18 to the open position shown in FIGS. 19-21 using a sliding movement, such as in opposite first and second sliding directions 174, 176. That is, the terminal covers 500 are slidable with respect to the housing 188 of the switching device 10. A first terminal cover 500 would be movable in the first direction 174 to close and the second direction 176 to open, however a second terminal cover 500 would be movable in the second direction 176 to close and the first direction 174 to open. The terminal cover 500 includes at least a cover panel 502 that is movable from the open position to the closed position. As further shown in FIG. 22, the cover panel 502 may include a ramped surface 504 to provide a substantially smooth outer surface of the switching device 10 when the terminal cover 500 is closed. The cover panel 502 further includes a first longitudinal side 506 and a second longitudinal side 508. The first longitudinal side 506 may be substantially aligned with the line side 206 (and load side 208 for a second terminal cover) in the closed position shown in FIG. 18. Also in the closed position, the second longitudinal side 508 abuts a portion of the switching device cover 18, such as the second cover portion 220 shown in FIG. 18, but can also abut the first cover portion 218 when a second terminal cover 500 is employed. As illustrated in FIG. 18, when the terminal cover 500 is in the closed position, the apertures 509 are blocked and access to the terminals 210, 212 is prevented.

Figure 20:
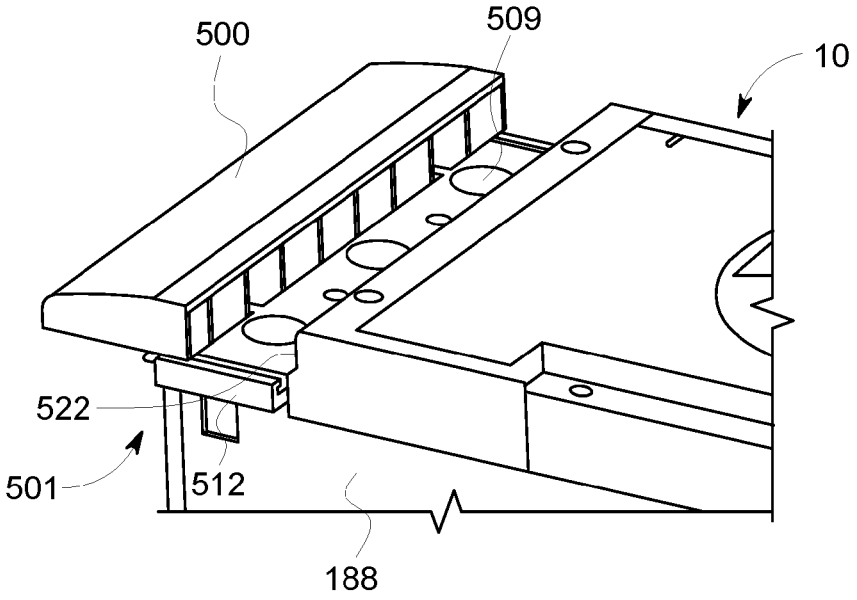
FIG. 20 is a perspective of the switching device of FIG. 18 with the terminal cover in an open position.
Figure 21:
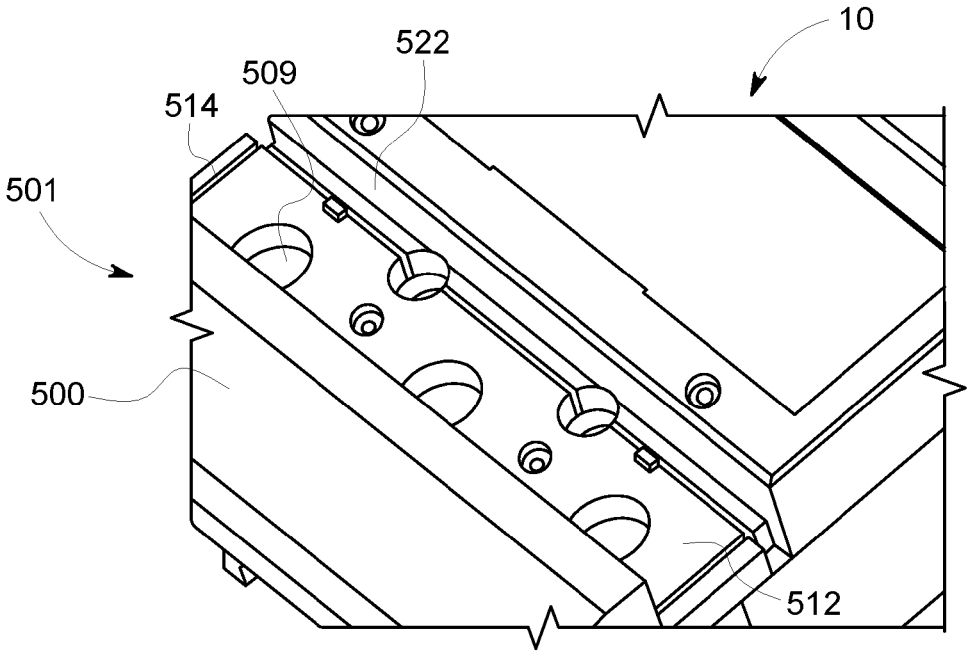
FIG. 21 is a perspective view of the switching device of FIG. 18 with the terminal cover in an open position.
Figure 22:
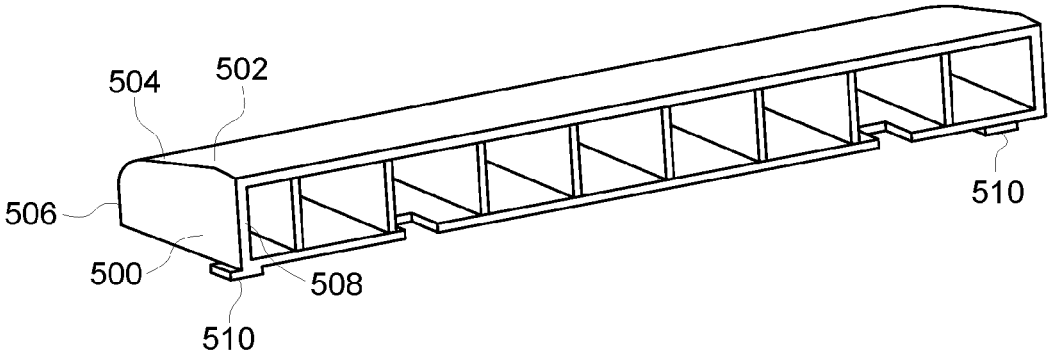
FIG. 22 is a perspective view of the terminal cover for the switching device of FIG. 18; and, FIG. 23 is a perspective view of an embodiment of an aperture plate for a terminal cover assembly including the terminal cover of FIG. 22.
Figure 23:
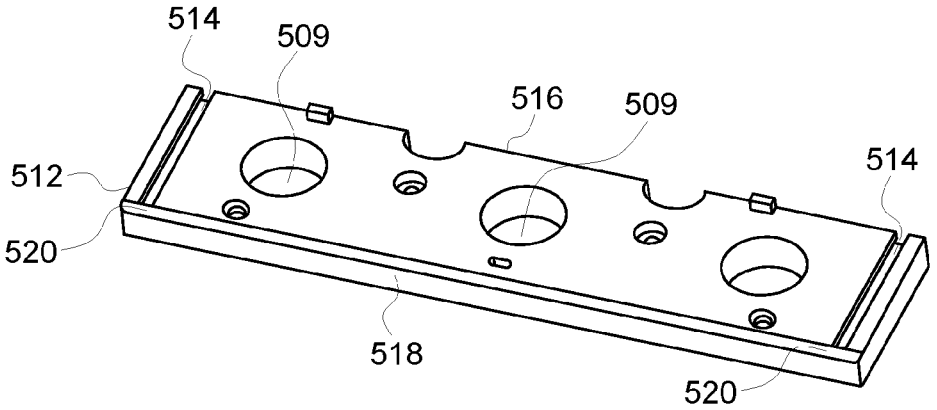

To enable the sliding movement of the terminal cover 500 with respect to the housing 188, the terminal cover 500 is provided with a tongue 510 (FIG. 22), while an aperture plate 512 of the terminal cover assembly 501 is provided with a groove 514 (FIG. 23). Alternatively, the groove may be provided on the terminal cover 500 and the tongue may be provided on the aperture plate 512. The tongue 510 may be rectangular shaped as shown, or may have any other shape such as a dovetail shape, so long as it remains trapped when inserted into the groove 514 of the aperture plate 512. The groove 514 may include a neck portion to trap the tongue 510 therein. Together, the tongue 510 and the groove 514 form a tongue and groove connection. In the illustrated embodiment, the tongue 510 is provided at the second longitudinal side 508 of the terminal cover 500, but not at the first longitudinal side 506. The groove 514 extends substantially from a second longitudinal side 516 of the aperture plate 512 to a first longitudinal side 518 of the aperture plate 512, however the groove 514 is blocked by obstruction 520, such as but not limited to a wall, at the first longitudinal side 518. Thus, when the terminal cover 500 is assembled onto the aperture plate 512, the tongue 510 of the terminal cover 500 can move in directions 174, 176 within the groove 514, but is prevented from sliding off the first longitudinal side 518 of the aperture plate 512 by the obstruction 520. When assembled onto the switching device 10, the terminal cover 500 is also prevented from sliding off the second longitudinal side 516 of the aperture plate 512 by a sidewall 522 of the switching device cover 18 (FIGS. 20 and 21). The terminal cover 500 may further include a latching mechanism to latch the terminal cover in the open and closed positions, such as, but not limited to, one or more latching devices, such as but not limited to spring clips, at the second longitudinal side 516 of the aperture plate 512 to retain the terminal cover 500 in the closed position, and one or more latching devices, such as but not limited to spring clips, at the first longitudinal side 518 of the aperture plate 512 to retain the terminal cover 500 in the open position. Other alternate latching mechanisms may be included, such as, but not limited to, those that take advantage of a retention force using the plastic material of the terminal cover 500.

Thus, the terminal cover 500 provides an alternate embodiment of providing an open position and a closed position while maintaining an attachment of the terminal cover 500 to the housing 188 in both positions. While various embodiments of the terminal covers 200, 400, and 500 have been described, each of the embodiments provide movable terminal covers 200, 400, 500 that are movable from an open position and a closed position while maintaining an attachment of the terminal covers 200, 400, 500 to the housing 188 in both positions. The terminal covers 200, 400, 500 all provide access to the terminals 210, 212 in the open position, and block access in the closed position. When closed, the switching device 10 is provided with a finished look due to the aesthetic design of the terminal covers 200, 400, 500, in addition to protecting the terminals 210, 212. Various embodiments have been described to move the terminal covers 200, 400, 500 to an open condition, including those involving a pivoting motion and a sliding motion, however alternate embodiments may include a combination of linear and circular motions, translatory motion, and rotary motion.

Thus, a switching device includes a housing and a terminal cover assembly. The terminal cover assembly includes a first terminal cover movable between an open position and a closed position. The first terminal cover is attached to the housing in both the open position and the closed position.

The switching device may further include a terminal, wherein the first terminal cover covers the terminal in the closed position and provides access to the terminal in the open position.

The first terminal cover may be pivotally connected to the housing.

The first terminal cover may include two fingers and a cover panel connected between the two fingers, wherein the two fingers are pivotally connected to opposite sides of the housing.

The first terminal cover may include a longitudinal side, and the switching device may further include a hinge extending longitudinally along at least a portion of the longitudinal side, the hinge including a pin and mating profile.

The switching device may further include a handle, wherein the first terminal cover includes a hinged end and a free end, and, in the closed position of the first terminal cover, the hinged end is disposed between the free end and the handle.

The switching device may further include a latching system operatively arranged to selectively latch the first terminal cover in the open position and in the closed position.

The latching system may include a latching protrusion and a latching recess, the latching protrusion disposed in the latching recess in the closed position of the terminal cover, and the latching protrusion disposed outside of the latching recess in the open position of the terminal cover.

The latching system may include a latching cam, first and second detents, and a latching protrusion. The terminal cover may include the latching cam and the first and second detents, the latching cam disposed between the first and second detents, and the housing may include the latching protrusion.

The latching protrusion may be disposed within the first detent in the closed position of the first terminal cover and the latching protrusion may be disposed within the second detent in the open position of the first terminal cover.

The first terminal cover may further include a reflective surface.

The housing may include a line side and a load side, and the terminal cover assembly may further include a second terminal cover connected to the housing, wherein the first terminal cover is adjacent the line side and the second terminal cover is adjacent the load side.

The switching device may further include a line side terminal and a load side terminal. The first terminal cover may be movable in a first direction from a closed position to cover the line side terminal to an open position to provide access to the line side terminal, and the second terminal cover may be movable in a second direction from a closed position to cover the load side terminal to an open position to provide access to the load side terminal, wherein the first direction is opposite the second direction.

The switching device may further include a tongue and groove connection between the first terminal cover and the housing, and the first terminal cover may be slidably connected to the housing via the tongue and groove connection.

The terminal cover may include a cover panel, which may include at least one knockout.

In other embodiments, a switching device includes a housing including a base and a switching device cover; a line side terminal; a load side terminal; a first terminal assembly including a first terminal cover movably connected to the switching device cover; and, a second terminal assembly including a second terminal cover movably connected to the switching device cover. The first terminal cover is movable from a closed position to cover the line side terminal to an open position to provide access to the line side terminal, and the second terminal cover is movable from a closed position to cover the load side terminal to an open position to provide access to the load side terminal.

The switching device may further include a latching system arranged to selectively latch the first terminal cover in the closed position and the open position of the first terminal cover, and a latching system arranged to selectively latch the second terminal cover in the closed position and the open position of the second terminal cover.

The first and second terminal covers may be pivotally attached to the housing.

The first and second terminal covers may be slidably attached to the housing.

In other embodiments, a method of covering and accessing a terminal in a switching device includes attaching a first terminal cover to a housing of the switching device; covering the terminal with the first terminal cover in a closed position of the first terminal cover; moving the first terminal cover to an open position to access the terminal; and, retaining an attachment of the first terminal cover to the housing in the open position.

Moving the first terminal cover to an open position may include pivoting the first terminal cover with respect to the housing.

Moving the first terminal cover to an open position may include sliding the first terminal cover with respect to the housing.

Covering the terminal may further include latching the first terminal cover to the housing in the closed position.

Accessing the terminal may further include latching the first terminal cover to the housing in the open position.

The method may further include reflecting light onto the terminal from a reflective surface on the first terminal cover.

The method may further include knocking out a knockout portion in the first terminal cover.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A switching device comprising:

a housing comprising a latching protrusion, a base and a switching device cover coupled to said base;

a line side terminal positioned on a line side of said housing;

a load side terminal positioned on a load side of said housing, wherein the line side is opposite the load side;

a first terminal cover coupled to said switching device cover proximate the line side;

a second terminal cover coupled to said switching device cover proximate the load side, wherein said first terminal cover is movable between a closed position and an open position, wherein said first terminal cover covers said line side terminal in the closed position and provides access to said line side terminal in the open position, wherein said first terminal cover is attached to said switching device cover in both the closed and open positions, wherein said second terminal cover is moveable between a closed position and an open position, wherein said second terminal cover covers said load side terminal in the closed position and provides access to said load side terminal in the open position, and wherein said second terminal cover is attached to said switching device cover in both the closed and open positions;

a first latching system that selectively latches said first terminal cover in the closed position and the open position, wherein said latching protrusion positively latches said first terminal cover in the open position; and a handle extending through a handle slot formed in said switching device cover, said handle disposed between said first and second terminal covers and operable to switch said switching device.

2. The switching device of claim 1, further comprising a second latching system that selectively latches said second terminal cover in the closed position and the open position.

3. The switching device of claim 1, wherein said first and second terminal covers are slidably attached to said switching device cover.

4. The switching device of claim 1, wherein said first and second terminal covers are pivotally coupled to said switching device cover.

5. The switching device of claim 4, wherein said first terminal cover comprises two fingers and a cover panel extending between said two fingers, wherein said two fingers are pivotally coupled to said switching device cover.

6. The switching device of claim 4, wherein said first terminal cover comprises a longitudinal side and a hinge extending along at least a portion of said longitudinal side, said hinge comprising a pin that rotatably engages said switching device cover.

7. The switching device of claim 4, wherein said first terminal cover comprises a hinged end and a free end, and, in the closed position of said first terminal cover, said hinged end is disposed between said free end and said handle.

8. A circuit breaker comprising:

a housing comprising a switching device cover and a latching protrusion, said housing having a line side and a load side;

a terminal cover assembly comprising a first terminal cover coupled to said switching device cover proximate one of the line side and the load side of said housing, wherein said first terminal cover is movable between an open position and a closed position, wherein said first terminal cover covers terminals at one of the line side and the load side in the closed position, wherein said first terminal cover provides access to the terminals in the open position, and wherein said first terminal cover is attached to said switching device cover in both the open and closed positions;

a latching system that selectively latches said first terminal cover in the open position and in the closed position, wherein said latching protrusion positively latches said first terminal cover in the open position; and a handle extending through a handle slot formed in said switching device cover, said handle disposed between the line side and the load side and operable to switch said circuit breaker.

9. The circuit breaker of claim 8, wherein said latching system comprises said latching protrusion and a latching recess, wherein said latching protrusion is disposed in said latching recess when said first terminal cover is in the closed position, and wherein said latching protrusion is disposed outside of said latching recess when said first terminal cover is in the open position.

10. The circuit breaker of claim 8, wherein said first terminal cover comprises a reflective surface.

11. The circuit breaker of claim 8, wherein said latching system comprises a latching cam, first and second detents, and said latching protrusion, wherein said latching cam is disposed between said first and second detents on said first terminal cover.

12. The circuit breaker of claim 11, wherein said latching protrusion is disposed within said first detent when said first terminal cover is in the closed position, and wherein said latching protrusion is disposed within said second detent when said first terminal cover is in the open position.

13. The circuit breaker of claim 8, wherein said terminal cover assembly further comprises a second terminal cover coupled to said switching device cover proximate the other of the line side and the load side of said housing, said second terminal cover moveable between an open position and a closed position.

14. The circuit breaker of claim 13, wherein said first terminal cover is movable in a first direction from the closed position to the open position, wherein said second terminal cover is moveable in a second direction from the closed position to the open position, and wherein the first direction is opposite to the second direction.

15. The circuit breaker of claim 8, wherein said first terminal cover is pivotally coupled to said switching device cover.

16. The circuit breaker of claim 15, wherein said first terminal cover comprises two fingers and a cover panel extending between said two fingers, wherein said two fingers are pivotally coupled to said switching device cover.

17. The circuit breaker of claim 15, wherein said first terminal cover comprises a longitudinal side and a hinge extending along at least a portion of said longitudinal side, said hinge comprising a pin that rotatably engages said switching device cover.

18. The circuit breaker of claim 15, wherein said first terminal cover comprises a hinged end and a free end, and, in the closed position of said first terminal cover, said hinged end is disposed between said free end and said handle.

19. A method of selectively covering and accessing a terminal in a switching device, the switching device including a housing and a switching device cover coupled to the housing, the housing including a latching protrusion, the method comprising:

coupling a first terminal cover to the switching device cover;

coupling a handle to the switching device cover, the handle extending through a handle slot formed in the switching device cover, said handle disposed between a line side and a load side of the housing and operable to switch the switching device;

placing the first terminal cover in a closed position to cover the terminal;

moving the first terminal cover from the closed position to an open position to access the terminal, wherein the first terminal cover is attached to the switching device cover in both the closed and open positions; and latching the first terminal cover to the housing in the open position, wherein the latching protrusion of the housing positively latches the first terminal cover in the open position.

20. The method of claim 19, wherein moving the first terminal cover from the closed position to an open position comprises pivoting the first terminal cover with respect to the housing.

21. The method of claim 19, wherein moving the first terminal cover from the closed position to an open position comprises sliding the first terminal cover with respect to the housing.

22. The method of claim 19, wherein placing the first terminal cover in a closed position comprises latching the first terminal cover to the housing in the closed position.

23. The method of claim 19, further comprising reflecting light onto the terminal using a reflective surface on the first terminal cover.

24. The method of claim 19, further comprising knocking out a knockout portion formed in the first terminal cover.

* * * * *